United States Patent [19]

Harma

[11] Patent Number: 4,997,167

[45] Date of Patent: Mar. 5, 1991

[54] LADLE INOCULANT DISPENSER

[75] Inventor: Pertti Harma, late of Södertälje, Sweden, by Anna Harma, executor

[73] Assignee: Elkem a/s, Norway

[21] Appl. No.: 388,995

[22] Filed: Aug. 3, 1989

[30] Foreign Application Priority Data

Aug. 4, 1988 [NO] Norway ..... 883453

[51] Int. Cl.[5] ..... C21L 7/00

[52] U.S. Cl. ..... 266/216; 266/266

[58] Field of Search ..... 222/591; 266/216, 266; 75/51.1, 53

[56] References Cited

U.S. PATENT DOCUMENTS

| | | | |
|---|---|---|---|
| 3,826,539 | 7/1974 | Kunz et al. | 266/216 |
| 3,849,123 | 11/1974 | Wester, Jr. et al. | 266/216 |
| 3,929,464 | 12/1975 | Tedd et al. | 266/216 |
| 4,010,938 | 3/1977 | Crudup | 266/216 |

*Primary Examiner*—S. Kastler

*Attorney, Agent, or Firm*—Lucas & Just

[57] ABSTRACT

The present invention relates to a dispensing equipment for adding inoculants to the stream of molten iron flowing from the spout of a tilting ladle. The dispensing equipment comprises a hopper (4) for the inoculant which hopper has an outlet opening (5) which extends through the wall of a first pipe 6. Means (9) is arranged for continuously and adjustably transportation of inoculant from the hopper (4) through the first pipe (6) and a second pipe 8 into the spout (1) of the ladle. The second pipe (8) is rotatably connected to the first pipe (6). A mounting frame (18) is suspended from the first pipe (6) by means of at least two bearings (16, 17), which bearings (16, 17) are rotatably arranged about the first pipe (6). The mounting frame (18) is firmly affixed to the second pipe (8), and a mounting arm (21) is fixed to the mounting frame (18), said mounting arm being intended to cooperate with a mounting bracket (3) on the ladle spout (1).

11 Claims, 2 Drawing Sheets

Figure 1:
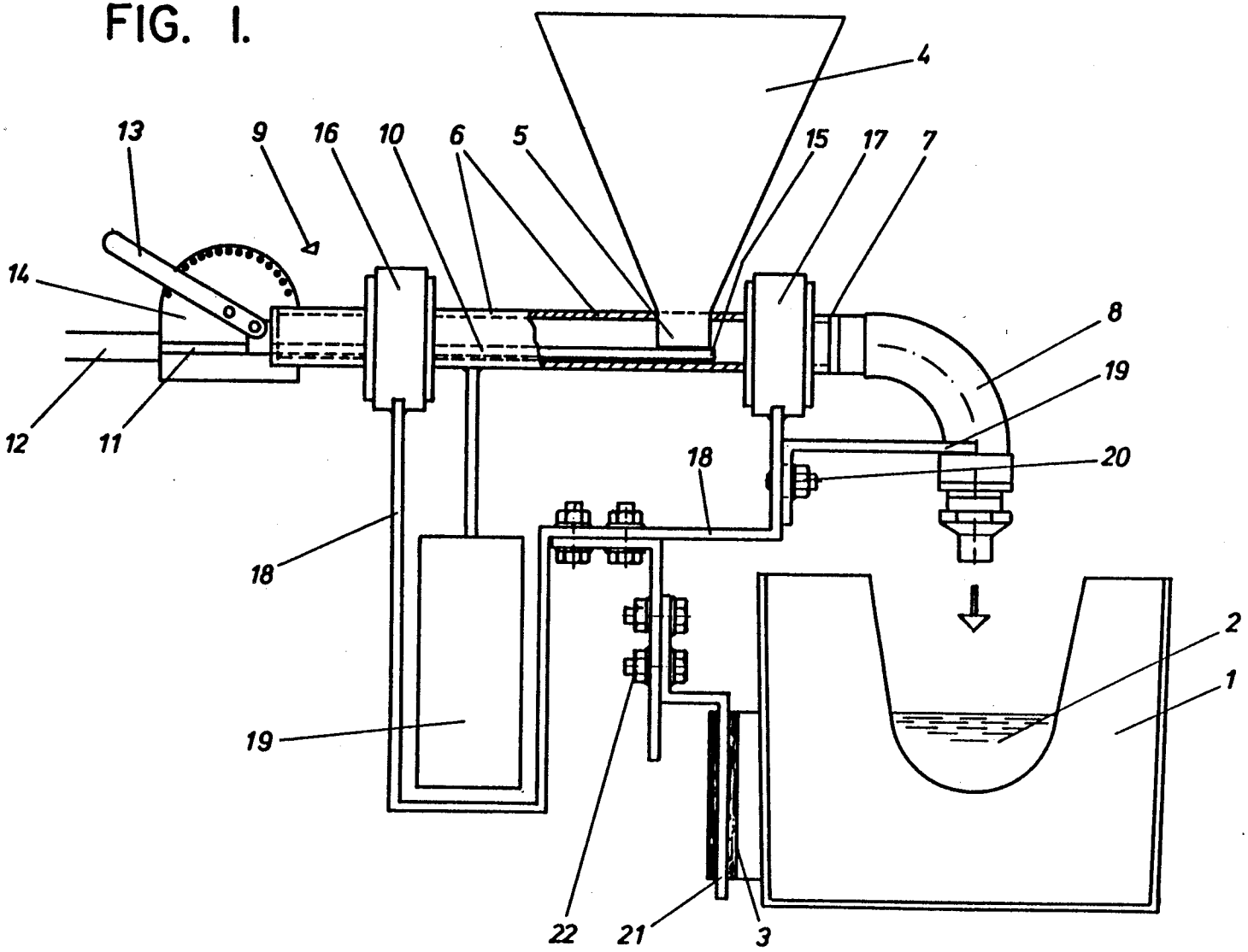

FIG. I.

LADLE INOCULANT DISPENSER

The present invention relates to a dispensing equipment for delivering inoculants into the stream of molten iron which flows from the spout of a tilting ladle.

Inoculant additions made to the iron stream during casting are technically and economically superior to the inoculant-addition added when filling the ladle with molten iron. The reasons for this is that inoculant performance fades with time after it is added to the molten iron. The shorter the time from inoculant addition to casting, the better is the effect and less inoculant is required. Further, the deterioration in inoculant performance with time may result in variable quality and inhomogenity from the start to the end of the pouring of iron from the ladle.

By continuously adding inoculant to the casting stream during pouring it is possible, to a high extent to improve the uniformity and quality of the final iron castings.

For continuous addition of inoculants into a stream of molten iron in the spout of a tilting ladle it is necessary to have a dispensing equipment for the inoculants which makes it possible to provide a directed flow of inoculant towards the same position on the ladle spout throughout the casting process.

Accordingly the present invention relates to a dispensing equipment for adding inoculants to the stream of molten iron which flows from the spout of a tilting ladle, the dispensing equipment comprising a hopper for inoculant, said hopper having an outlet opening which extends through the wall of a first pipe, means for continuously and adjustably transporting inoculant from the hopper through the first pipe and a second pipe into the spout of the ladle, said second pipe being rotatably connected to the first pipe, a mounting frame suspended on the first pipe by means of at least two bearings, which bearings are rotatably arranged about the first pipe, said mounting frame being fixed to the second pipe, a counterweight suspended from the first pipe, and a mounting arm fixed to the mounting frame, said mounting arm being intended to cooperate with a mounting bracket on the ladle spout.

According to a preferred embodiment of the present invention the means for continuous and adjustable transportation of inoculant from the hopper comprises at least one tube which is inserted into the first pipe, one end of the tube being connected to a gas source and the other end being located below the opening in the hopper. The tube is equipped with means for longitudinal movement of the tube relative to the first pipe and with a gas-flow controller. Preferably there is arranged three injection tubes which can be moved individually and have independent gas-flow controllers.

By use of the inoculant dispensing unit according to the present invention, the unit is positioned in the mounting bracket on the spout of a tilting ladle, and the hopper is filled with inoculant. When the pouring of iron from the ladle starts, a gas-flow valve is opened to supply transport gas through the injection tube, and the end of the tube is positioned in the right position in relation to the opening in the hopper in such a way that a preset amount of inoculant is transported through the dispenser.

When the ladle starts to tilt, the mounting frame and the second pipe which is affixed to the mounting frame, will follow the tilting movement of the ladle. The position of the second pipe relative to the spout will therefore remain the same, and the inoculant is thus delivered to the same spot in the ladle spout throughout the tilting operation. However, the hopper containing the inoculant, the first pipe and the inoculant transportation means will remain in the same vertical position throughout the tilting operation due to the counterweight and the rotational bearings of the mounting frame.

By the inoculant dispensing unit according to the present invention it is thus possible to continuously add inoculant to the molten stream of iron in the spout of a tiltable ladle during the complete pouring/tilting operation. The inoculant will automatically be delivered to the same area in the spout and in a correct amount. Further if the pouring for some reason is discontinued, the addition of inoculant can be stopped immediately by closing the gas-flow to the injection tube.

The complete operation of the inoculant dispensing unit can easily be conducted from a control-room by remote control.

Figure 2:
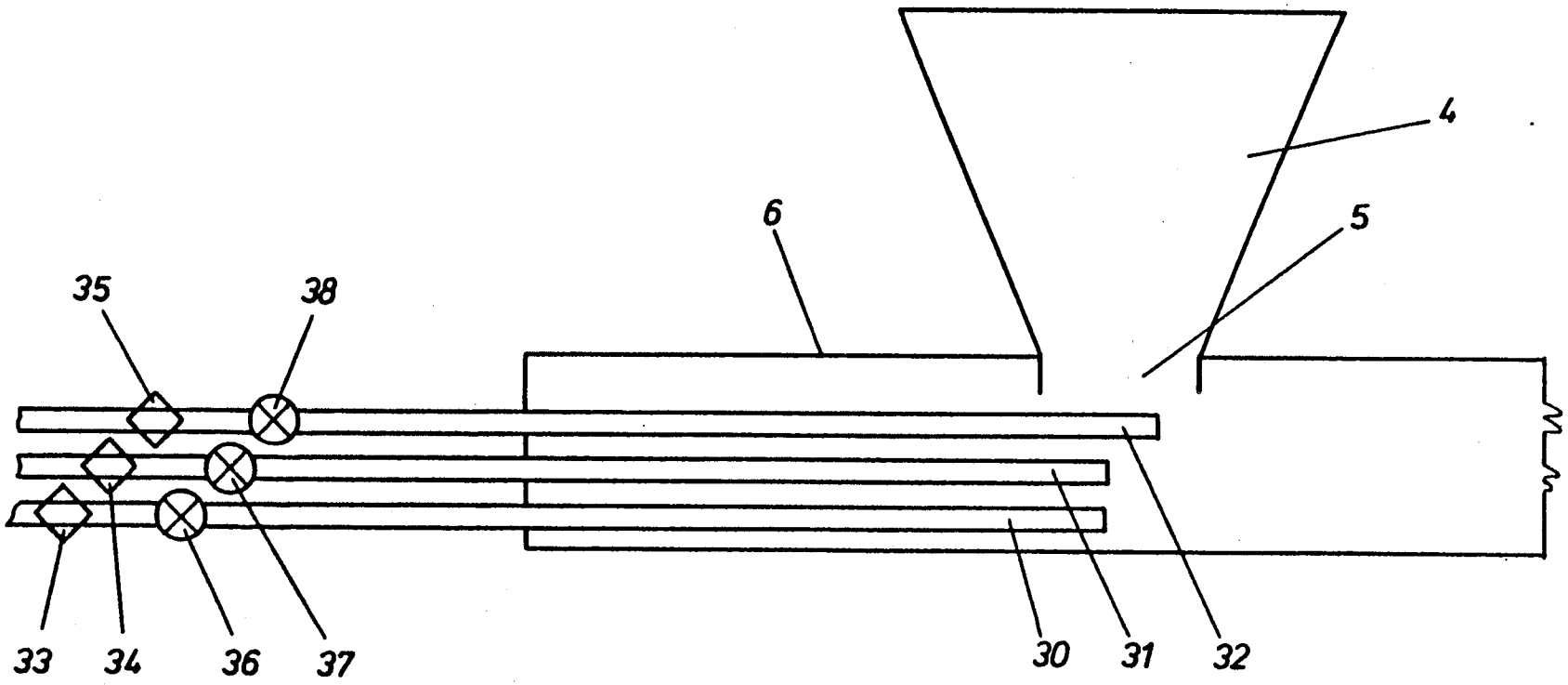

The present invention will now be further described with reference to the accompanying drawings in which:

FIG. 1 shows a side elevation of an inoculant dispensing unit according to the present invention, mounted on the spout of a tiltable ladle, and, FIG. 2 shows a preferred embodiment of a part of the dispensing unit.

In FIG. 1 there is shown a spout 1 of a tiltable ladle. A stream of iron pouring from the spout 1 is indicated by reference numeral 2. On one of its sides the spout 1 has a mounting bracket 3 for mounting of the inoculant dispensing unit according to the present invention.

The inoculant dispensing unit comprises a hopper 4 intended to contain inoculant to be added to the stream of iron 2 flowing in the spout 1. The hopper 4 has in its bottom an outlet opening 5 for the inoculant. The lower end of the hopper 4 extends through the wall of a first pipe 6 and the inoculant is allowed to fall by gravity from the hopper 4 into the first pipe 6.

At 7 a second pipe 8 is connected to the first pipe 6 in such a way that the second pipe 8 can rotate relatively to the first pipe 6.

An inoculant transportation means is shown by reference numeral 9. The transportation means 9 comprises a tube 10 which is inserted into the first pipe 6. The tube 10 is at one end 11 connected to a pressurized air or inert gas source 12. The tube 10 can be moved longitudinally with respect to the first pipe 6 by means of an arm 13 mounted on a bracket 14. By adjusting the position of the tube 10 such a way that the end 15 is positioned near the outlet opening 5 of the hopper 4 the amount of inoculant transported from the hopper 4 through the first and second pipes 6 and 8 and into the iron stream 2 in the spout 1 can be regulated.

The hopper 4, the first pipe 6 and the inoculant transportation means 9 is carried by two bearings 16 and 17 which are connected to a mounting frame 18. The bearings 16, 17 can rotate freely about the first pipe 6. In order to keep the hopper 4, the first pipe 6 and the inoculant transportation means 9 in a stable vertical position, a counterweight 19 is connected to the underside of the first pipe 6. The second pipe 8 is connected to the mounting frame 18 by a rail 19 which is fixed to the second pipe 8 by welding or the like and to the mounting frame 18 by means of bolt and nut 20. A mounting arm 21 which can be positioned in the mounting bracket 3 on the spout 1 is fixed to the mounting frame 18 by means of bolts and nuts 23.

Thus the second pipe 8 which delivers the inoculant to the iron stream 2 in the spout 1 is fixed in relation to the mounting frame 18 and thereby also in relation to the spout 1, while the hopper 4, the first pipe 6 and the inoculant transportation means 9 can rotate in the bearings 16 and 17. Thus when the ladle is tilted, the mounting frame 18 and the second pipe 8 rotate together with the ladle, while the hopper 4, the first pipe 6 and the transportation means 9 remains in vertical position due to the counterweight 19. This also ensures that the outlet end of the second pipe 8 always will remain in the exactly same position relative to the spout 1 regardless of the tilting of the ladle. The inoculant will thereby be added to the exactly same place in the spout 2 from start of pouring and until the pouring is finished.

In order to obtain a better regulation of the amount of inoculant injected, the inoculant transportation means 9 preferably comprises more than one tube 10.

In FIG. 2 there is shown an inoculant transportation means 9 which comprises three tubes 30, 31, 32. Each of the tubes has a variable gas flow controller 33, 34, 35 and on-off controller 36, 37, 38. Further, each of the tubes 30, 31, 32 has means for longitudinal movement of the tubes relative to the first pipe 6. By adjusting the gas flow rate and the outlet end position of each tube it is thereby possible to adjust the amount of inoculant transported to the iron very accurately, and over an extended range of flow rate possibilities.

I claim:

1. A dispensing apparatus for adding inoculants to the stream of molten iron flowing from the spout of a tilting ladle, wherein the dispensing apparatus comprises a hopper (4) for the inoculant, said hopper having an outlet opening (5) which extends through the wall of a first pipe (6), means (9) for continuous and adjustable transportation of inoculant from the hopper (4) through the first pipe (6) and a second pipe (8) into the spout (1) of the ladle, the second pipe (8) being connected to the first pipe (6) such that the second pipe (8) rotates about the longitudinal axis of the first pipe (6), a mounting frame (18) suspended from the first pipe (6) by means of at least two bearings (16, 17), which bearings (16, 17) are rotatably arranged about the first pipe (6), the mounting frame (18) being firmly affixed to the second pipe (8), a counterweight means (19) being connected to the first pipe (6), a mounting arm (21) fixed to the mounting frame (18), and a mounting bracket (3) connected to the ladle spout (1), the mounting arm cooperating with the mounting bracket (3), the mounting frame (18), the second pipe (8), and the ladle spout (1) all being connected such that the second pipe (8) and the ladle spout (1) move together.

2. The dispensing apparatus of claim 1, wherein the means (9) for transportation of inoculant comprises at least one tube (10) which is inserted into the first pipe (6), one end of said tube (10) being connected to a gas source (12) and the other end (15) being located below the opening (5) of the hopper (4).

3. The dispensing apparatus of claim 2, wherein the at least one tube (10) is equipped with means for longitudinal movement of the tube with respect to the first pipe (6).

4. A dispensing apparatus for adding inoculants to the stream of molten iron flowing from the spout of a tilting ladle comprising:

(a) a mounting frame affixed to the tilting ladle;

(b) a first pipe means for introducing inoculants into a stream of molten iron flowing from the spout, said first pipe means affixed to said mounting frame and positioned above the spout of the tilting ladle;

(c) an inoculant supply means for supplying inoculant to said first pipe means, said inoculant supply means rotatably mounted on said mounting frame so as to rotate during the tilting of the ladle; and (d) a counterweight means affixed to the inoculant supply means such that said counterweight means causes said inoculant supply means to remain in a vertical position during tilting of the ladle.

5. The dispensing apparatus of claim 4 wherein the inoculant supply means comprises a second pipe means rotatably mounted on said mounting frame and connected at one end to said first pipe means, said second pipe means having an opening, a hopper affixed on said second pipe means and an outlet in the opening of said second pipe; and an inoculant transportation means which comprises at least one tube which is inserted into the second pipe means, one end of said tube being connected to a gas source and the other end being located below the outlet of the hopper.

6. The dispensing apparatus of claim 5 wherein said tube is equipped with means for longitudinal movement of said tube with respect to the first pipe.

7. The dispensing apparatus of claim 4 wherein said inoculant supply means comprises a hopper for inoculant to be added, the hopper having an outlet opening; and a second pipe means rotatably mounted to said mounting frame, said second pipe means having a wall opening such that inoculant can pass through the outlet opening of the hopper into the wall opening.

8. The dispensing apparatus of claim 7 wherein the second pipe means is connected to the first pipe means such that the second pipe means rotates about the longitudinal axis of the first pipe means.

9. The dispensing apparatus of claim 7 wherein the means for allowing the mounting frame to rotate around the second pipe means is at least two bearings which are rotatably arranged about the first pipe means.

10. The dispensing apparatus of claim 7 wherein the inoculant supply mean s comprises an inoculant transportation means comprising at least one tube which is inserted into the second pipe means, one end of the tube being connected to a gas source and the other end being located below the outlet opening of the hopper.

11. The dispensing apparatus of claim 10 wherein the tube is equipped with means for longitudinal movement of the tube with respect to the second pipe means.

* * * * *